US007059084B2

(12) United States Patent
Hoskeer

(10) Patent No.: US 7,059,084 B2
(45) Date of Patent: Jun. 13, 2006

(54) GARAGE DOOR OPENER

(76) Inventor: Joseph E. Hoskeer, 14 Parks Dr., Sherborn, MA (US) 01770

( * ) Notice: Subject to any disclaimer, the term of this patent is extended or adjusted under 35 U.S.C. 154(b) by 251 days.

(21) Appl. No.: 10/626,180

(22) Filed: Jul. 23, 2003

(65) Prior Publication Data

US 2005/0016068 A1 Jan. 27, 2005

(51) Int. Cl.
*E05F 17/00* (2006.01)

(52) U.S. Cl. ..... 49/118; 49/366; 49/324; 49/356

(58) Field of Classification Search ..... 49/104, 49/109, 110, 116, 118, 120, 366, 324, 356
See application file for complete search history.

(56) References Cited

U.S. PATENT DOCUMENTS 1,468,081 A * 9/1923 Ross ..... 49/109
1,478,601 A * 12/1923 Davis ..... 49/113
1,480,958 A * 1/1924 Schneider ..... 49/109
1,544,542 A * 7/1925 Ainsworth ..... 49/113
1,570,641 A * 1/1926 Perkins ..... 49/103
1,700,848 A * 2/1929 Martin ..... 49/35
1,804,231 A * 5/1931 Rantz ..... 292/278
1,900,176 A * 3/1933 Flewell ..... 49/109
1,905,126 A * 4/1933 Beeman ..... 49/108
2,032,803 A * 3/1936 Hunter ..... 49/109
2,034,445 A * 3/1936 Robinson ..... 49/113
2,601,604 A * 6/1952 Ford ..... 49/109
3,633,250 A * 1/1972 Romney ..... 403/76
3,891,111 A * 6/1975 Snazuk ..... 217/60 F
5,239,776 A 8/1993 Lhotak
5,988,710 A * 11/1999 Kortschot et al. ..... 292/339
6,324,787 B1 * 12/2001 Burr ..... 49/109

* cited by examiner

*Primary Examiner*—Gregory J. Strimbu
(74) *Attorney, Agent, or Firm*—Lahive & Cockfield, LLP

(57) ABSTRACT

An automated garage door opener for opening an outwardly swinging door pivotally mounted about a vertical axis. The garage door opener includes a track, a trolley slidably mounted on the track, and at least one push bar having a first end and a second end. The push bar pivotally couples with the trolley at the first end and with the outwardly swinging door at the second end. A trolley coupling is provided for pivotally connecting the first end of the at least one push bar with the trolley. A door coupling for pivotally connecting the second end of the least one push bar with the outwardly swinging door is also provided. The door coupling is mountable on the outwardly swinging door. The push bar includes a spring biased slip joint for automatically adjusting the length of the push bar as the door opener is operated.

10 Claims, 7 Drawing Sheets

GARAGE DOOR OPENER

FIELD OF THE INVENTION

The present invention relates to a door opener, and more particularly, to a door opener mechanism for opening doors having vertically aligned hinges and swinging outwardly.

BACKGROUND OF THE INVENTION

In the field of garage doors, there are conventionally two more popular configurations. One configuration is a canopy-type door, which is supported on both sides of the door and lifts upwardly and outwardly to reveal the door opening. The second conventional configuration is a multi-sectioned track-guided door, which has multiple interconnected articulating sections supported at both sides by tracks and opens by sliding upwardly and articulating at the section breaks.

Both of the conventional garage door configurations can be opened by an automated garage door opener. In each instance, the conventional automated garage door opener mechanism includes a trolley that slides along a track and is motivated by a driving mechanism. The trolley slides back and forth along the track in a substantially horizontal direction toward the door and away from the door. Some form of coupling means is provided to connect the trolley with the door. With very little modification, if any, the single track horizontal automated garage door opener mechanism can be configured to open both the canopy-type door and the multi-section-type door.

In addition to the previously mentioned canopy-type garage door and multi-section-type garage door, there is a third configuration that is also relatively common. The third configuration involves a single or double door having substantially vertically aligned hinges along one side of each door. The door swings outwardly in the same fashion as a conventional front door of a house or door leading from one room to another within a house or building. This type of outwardly swinging garage door is most often found on barn-type buildings, carriage houses, other structures architecturally duplicating a barn or carriage house type structure, and the like. There has not been provided an adequate solution for an automated garage door opener for such outwardly swinging doors. The conventional single track opener, as previously described, has only been able to accommodate the canopy or multi-sectioned doors.

SUMMARY OF THE INVENTION

There is a need in the art for an automated garage door opener having the conventional single track single drive design, and further able to open outwardly swinging doors in either a single door or double door configuration. The present invention is directed toward further solutions to address this need.

In accordance with one embodiment of the present invention, a kit for converting a conventional automated door opener for a vertically sliding door to an automated door opener for opening an outwardly swinging door is provided. Generally, the outwardly swinging door is mounted for pivotal movement with substantially vertically aligned hinges disposed on one side of the outwardly swinging door, such that the outwardly swinging door swings outwardly to reveal an opening. The kit includes at least one push bar having a first end and a second end. The push bar pivotally couples with an existing trolley at the first end and with the outwardly swinging door at the second end. A trolley coupling is provided for pivotally connecting the first end of the at least one push bar with the existing trolley. The trolley coupling is mountable on the existing trolley. A door coupling for pivotally connecting the second end of the least one push bar with the outwardly swinging door is also provided. The door coupling is mountable on the outwardly swinging door.

In accordance with aspects of the present invention, the existing trolley can include a first trolley mechanism. A second trolley mechanism can also be provided that couples to the existing trolley mechanism and the at least one push bar using the trolley coupling. A second door coupling can additionally be provided that is mountable on an outwardly swinging second door in configurations where there are two doors to be opened. The at least one push bar can include a first push bar and a second push bar, the first push bar coupling to the trolley coupling and the door coupling, and the second push bar coupling to the trolley coupling and the second door coupling.

In accordance with further aspects of the present invention, the at least one push bar can further include at least one adjustment mechanism for adjusting the length of the at least one push bar. The at least one push bar can further include at least one slip joint coupled with a spring for automatically adjusting the length of the at least one push bar. The kit can further include a stabilizer bar for supporting the at least one push bar.

In accordance with another embodiment of the present invention, a door opener is provided. The door opener is configured for opening a door mounted for pivotal movement with substantially vertically aligned hinges disposed on one side of the door, such that the door swings outwardly to reveal an opening. The door opener can include a track disposed to extend substantially perpendicular from the door. A trolley can be provided that is slidably coupled with the track, such that the trolley can move along the track directionally generally toward the door and away from the door. At least one push bar can be provided having a first end and a second end. The push bar can be pivotally coupled with the trolley at the first end and with the door at the second end. Movement of the trolley along the track in a direction toward the door can cause the push bar to push the door outwardly away from the trolley to reveal the opening, while the push bar pivots forming an increasing angle with the track. Movement of the trolley along the track in a direction away from the door causes the push bar to pull the door inwardly toward the trolley to conceal the opening, while the push bar pivots forming a decreasing angle with the track.

In accordance with further aspects of the present invention, the door opener can further include a drive mechanism for moving the trolley along the track. The drive mechanism can be, for example, a screw drive or a chain drive. A motor can further be provided for powering the drive mechanism.

In accordance with further aspects of the present invention, the trolley can include a first trolley mechanism and a second trolley mechanism, the first trolley mechanism being coupled with the second trolley mechanism. In addition, the at least one push bar can further include at least one adjustment mechanism for adjusting the length of the at least one push bar. The at least one push bar can further include at least one slip joint coupled with a spring for automatically adjusting the length of the least one push bar. The at least one slip joint coupled with a spring can enable lengthening of the push bar while the at least one push bar maintains a pulling force on the door as the trolley moves in the direction away from the door.

In accordance with further aspects of the present invention, the door opener can further include a stabilizer bar for supporting the at least one push bar. The at least one push bar can further include a first push bar and a second push bar each push bar being disposed on opposing sides of the track. The door opener can further be configured to open two doors substantially simultaneously.

In accordance with another embodiment of the present invention, a door opener for opening a door mounted for pivotal movement is provided. The door has substantially vertically aligned hinges disposed on one side of the door, such that the door swings outwardly to reveal an opening. The door opener includes a track means disposed to extend substantially perpendicular to the door. A trolley means is slidably coupled with the track means, such that the trolley means can move along the track means directionally generally toward the door and away from the door. At least one push bar means having a first end and a second end can also be provided. The push bar means can be pivotally coupled with the trolley means at the first end and with the door at the second end. Movement of the trolley means along the track means in a direction toward the door can cause the push bar means to push the door outwardly away from the trolley means to reveal the opening while the push bar means pivots forming an increasing angle with the track means. In addition, movement of the trolley means along the track means in a direction away from the door can cause the push bar means to pull the door inwardly toward the trolley means to conceal the opening while the push bar means pivots forming a decreasing angle with the track means.

BRIEF DESCRIPTION OF THE DRAWINGS

The present invention will become better understood with reference to the following description and accompanying drawings, wherein.

DETAILED DESCRIPTION

Figure 1:
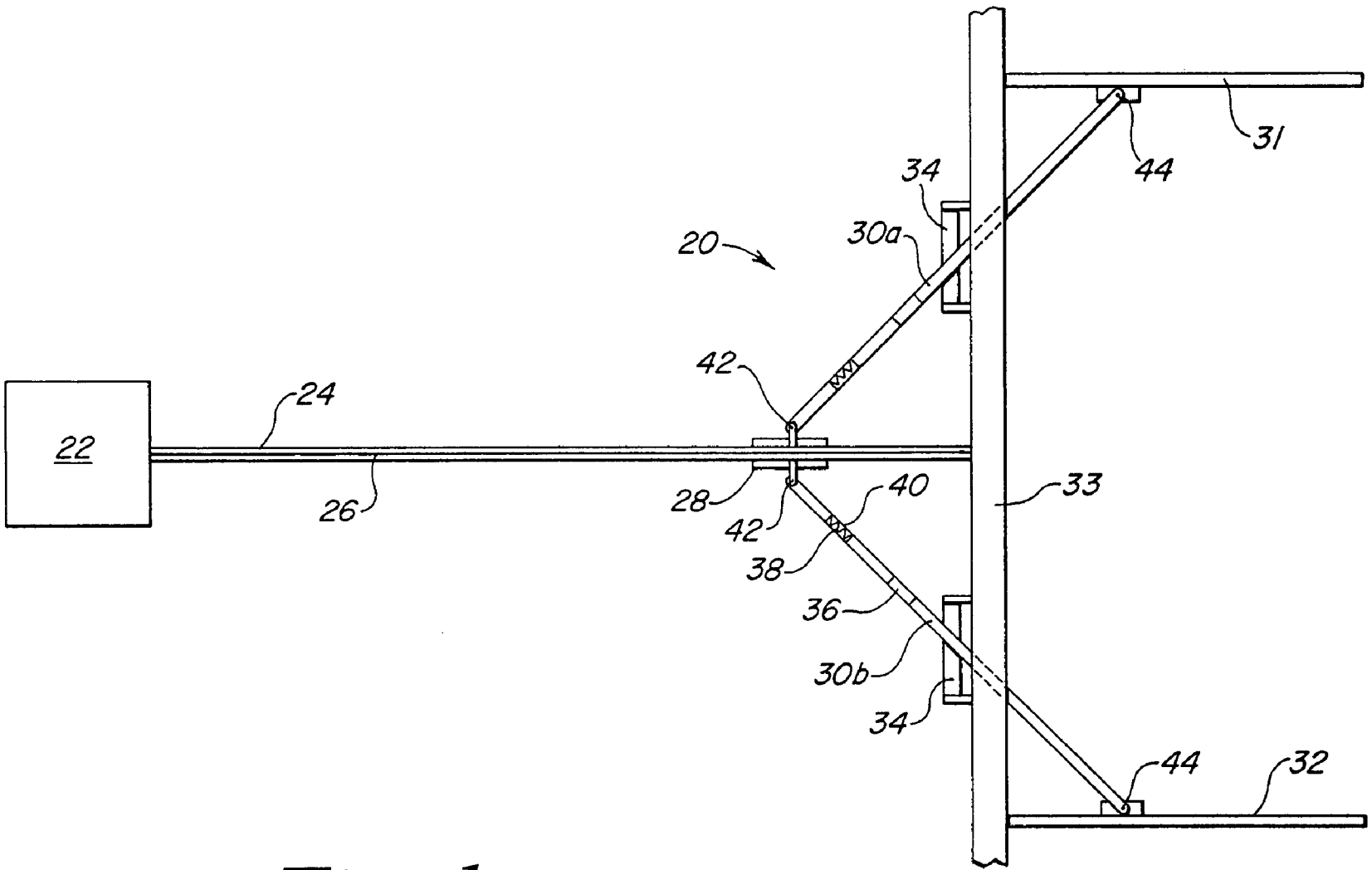
FIG. 1 is a diagrammatic illustration of a door opener according to one aspect of the present invention.
Figure 2:
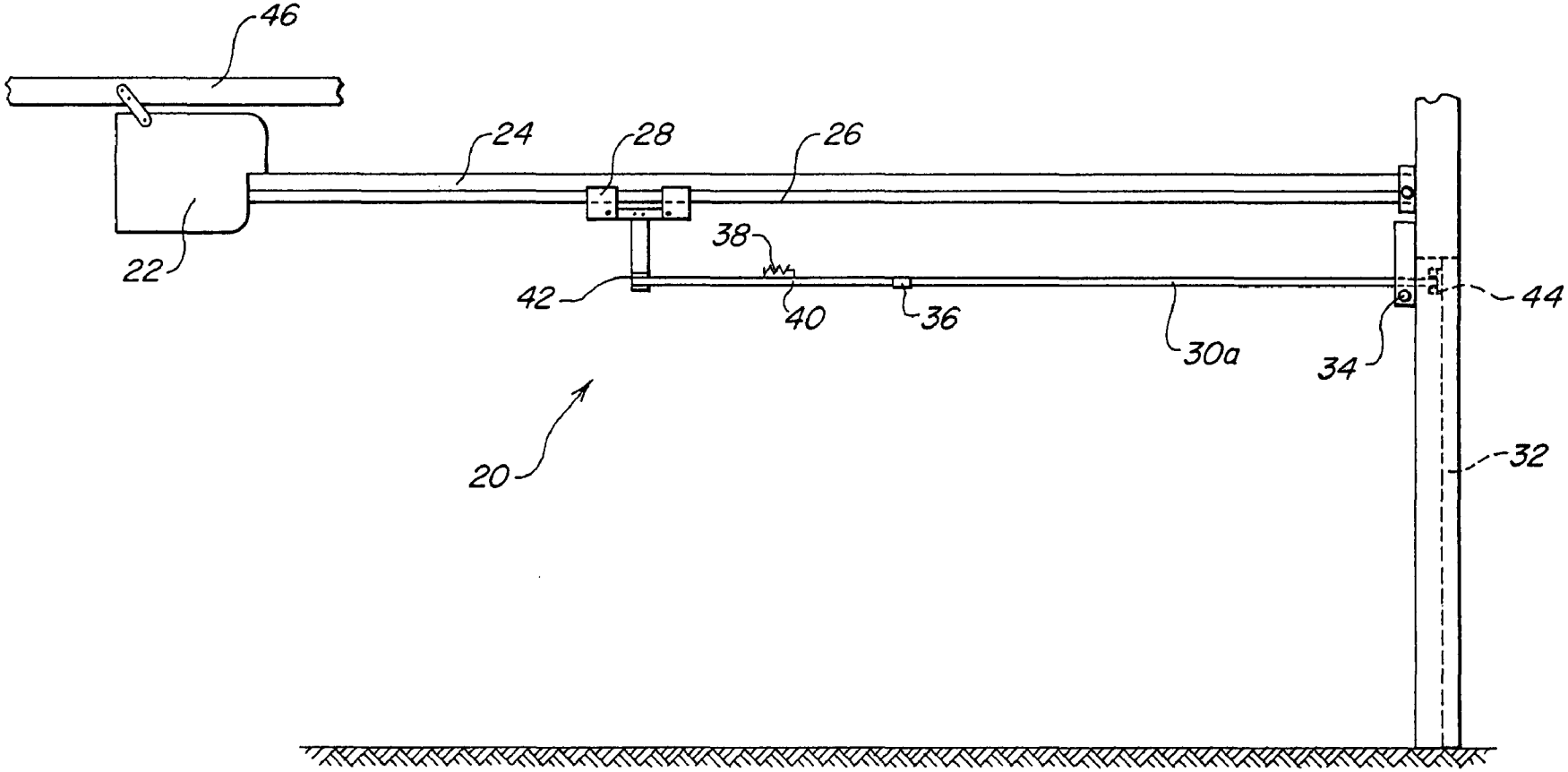
FIG. 2 is a diagrammatic side view illustration of the door opener of FIG. 1 according to one aspect of the present invention.
Figure 3:
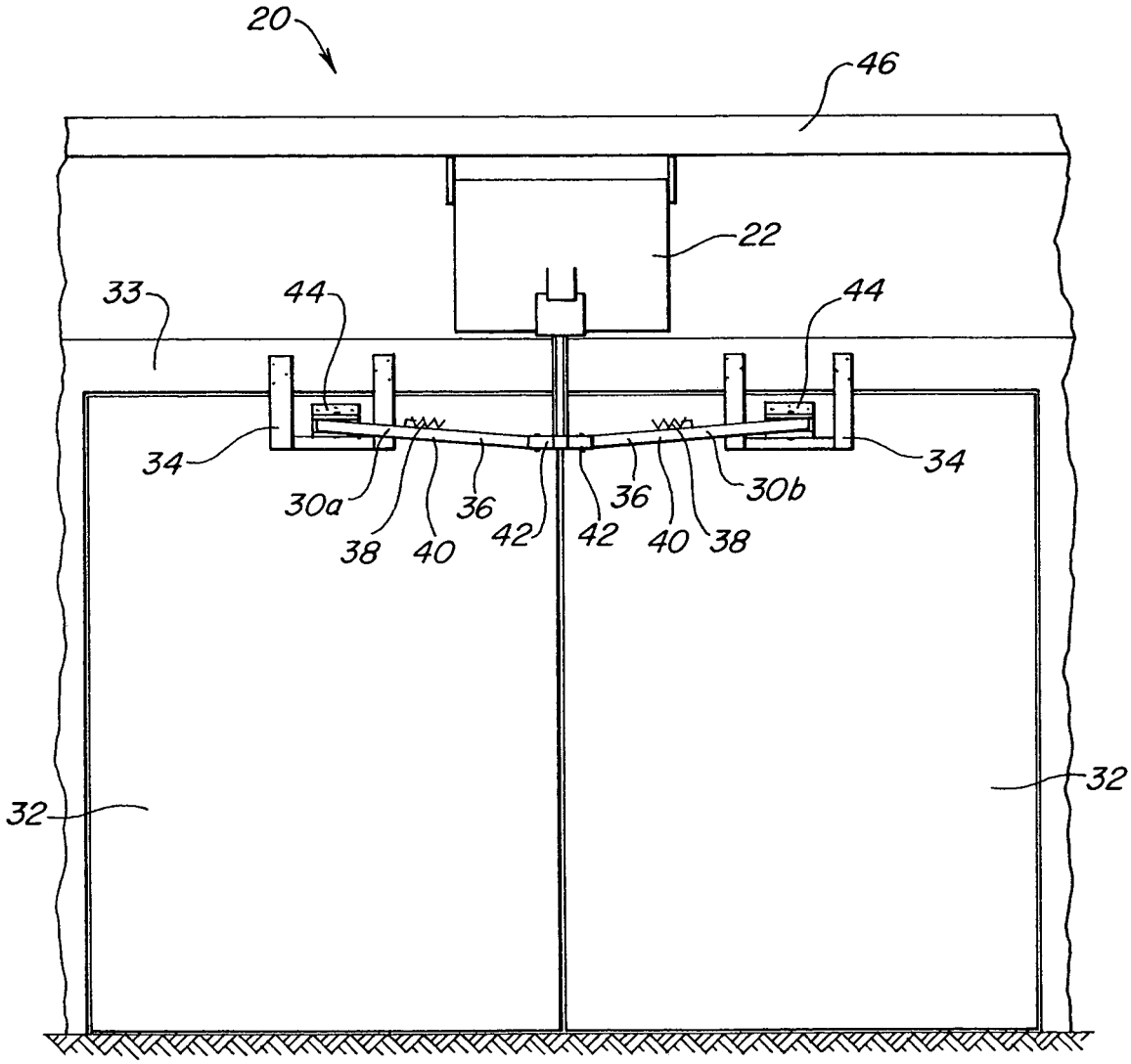
FIG. 3 is a diagrammatic end view of the door opener of FIG. 1 according to one aspect of the present invention.

An illustrative embodiment of the present invention relates to a door opener, and more specifically a mechanism for opening a vertically hinged outwardly swinging door using a conventional motor-driven single-track door opener device. Door opener devices such as those utilized with the present invention are most commonly found in a garage door opener configuration. Such devices include a motor, a single-track with a drive mechanism, and a coupling to the garage door. The automated garage door opener system can open and close the garage door upon receiving a signal from a wall-mounted switch or a remote control. Conventional automated garage door opener mechanisms are limited to use with vertically opening canopy doors or vertically opening multi-section doors. However, the present invention makes use of the same motor and track with single drive arrangement to open one or two vertically hinged outwardly swinging doors. Such doors are most often found in such architecturally related structures as barns or carriage houses. The components of the present invention can be purchased separately and in addition to a conventional garage door opener device and mounted with the structure of the conventional device, modifying the configuration to be appropriate for the vertically hinged outwardly swinging doors. Alternatively, the components of the present invention can be packaged together with the main components of an automated garage door opener device. Thus, the present invention can be sold as a complete garage door opener device, or can be sold as a kit modifying a conventional automated garage door opener device.

FIGS. 1 through 7 wherein like parts are designated by like reference numerals throughout, illustrate example embodiments of a door opener according to the present invention. Although the present invention will be described with reference to the example embodiments illustrated in the figures, it should be understood that many alternative forms can embody the present invention. One of ordinary skill in the art will additionally appreciate different ways to alter the parameters of the embodiments disclosed, such as the size, shape, or type of elements or materials, in a manner still in keeping with the spirit and scope of the present invention.

FIG. 1 is a diagrammatic illustration of a garage door opener mechanism 20 mounted in conjunction with conventional components of an automated garage door opener. When fully installed, the garage door opener mechanism 20 works in conjunction with a motor 22. The motor 22 is most often electrically powered, but can have alternate power sources. A track 24 and drive 26 extend from the motor 22 toward a door frame 33 of a first door 31 and a second door 32 to be coupled with the garage door opener mechanism 20. The drive 26 can have multiple different configurations, including a chain drive, or a screw drive, as understood by one of ordinary skill in the art. In addition, the track 24 and drive 26 can have a multi-track or multi-drive configuration, as understood by one of ordinary skill in the art. Thus, the present invention is not limited for use only with a single track, single drive, configuration.

The track 24 extends in a direction generally perpendicular to the door frame 33 as is conventional. By generally perpendicular, what is meant is that the track extends in a direction away from the door frame 33 in a manner that creates but is not limited to a substantially 90 degree angle between the door frame and the track 24. In addition to an actually perpendicular track, the present invention provides added flexibility to position the track in a manner that is substantially outward from the door frame 33, but not perfectly perpendicular. The track 24 can extend to the right or to the left of a perpendicular line to the door frame 33 and still function as designed. In fact, the track 24 can form a variety of different angles with the door frame 33 so long as sufficient force can be generated to open the first door 31 and a second door 32 as desired, and as understood by one of ordinary skill in the art. Thus, the present invention is not limited to the track 24 being perpendicular to the first door 31 and a second door 32 or the door frame 33, but rather generally perpendicular or in an outward direction are also anticipated by the present invention.

A trolley 28 is slidably coupled with the track 24, such that the trolley 28 can slide generally along the track 24. A push bar connector 30*a* and 30*b* couples with the trolley 28 at a trolley coupling 42, and couples with the first door 31 and a second door 32 at a door coupling 44. Both the trolley coupling 42 and the door coupling 44 provide pivotal couplings of the push bar connector 30*a* and 30*b* to the trolley 28 and the door 32 respectively. In the configuration illustrated, there are two doors shown, first door 31 and a second door 32. The garage door opener mechanism 20 of the present invention introduces the use of the push bar connector 30*a* and 30*b* in combination with the trolley 28 moving along the track 24 and driven by the drive 26 and the motor 22. Thus, the illustration shows two instances of the push bar connector as push bar connector 30*a* and push bar connector 30*b*, each instance extending to one of the first door 31 and the second door 32. Because each instance of the push bar connector 30*a* and 30*b* is identical, and for purposes of clarity, the present invention is described herein in terms of the operation of the push bar connector 30*a* and 30*b* in conjunction with the trolley 28 and the motor 22 to open a single door or two doors interchangeably, such as either of the first door 31 and the second door 32. Thus, there is no differentiation between the use of a single push bar connector, and two push bar connectors 30*a* and 30*b*. However, one of ordinary skill in the art will additionally appreciate that the more common configuration of such outwardly swinging doors is to have two doors operating at a single opening, thus the illustration of FIG. 1 shows the present invention in operation with two doors, the first door 31 and the second door 32. In addition, when the trolley 28 pushes the push bar connector 30*a* and 30*b* to open the first door 31 and a second door 32, there is better balance of lateral forces acting upon the trolley 28, thus making operation of the present invention easier. However, the present invention can function opening only one of the first door 31 and a second door 32, for example if there is only one door, and the teachings of the present invention apply. As such, the present invention is neither limited to use with only one door, or only two doors. It should likewise be noted that additional description concerning the push bar connector 30*a* and 30*b* and detailing elements of the connector use a single reference number to describe like elements of each of the push bar connectors 30*a* and 30*b*.

Continuing with the discussion of the components of the garage door opener mechanism 20 in accordance with the present invention, the push bar connector 30*a* and 30*b* can be supported by a stabilizer bar 34. The stabilizer bar 34 provides support for the push bar connector 30*a* and 30*b* to prevent excessive sagging or bending of the push bar connector 30*a* and 30*b* during operation. The stabilizer bar 34 mounts to the door frame 33, or other structure able to provide support generally along a middle portion of the push bar connector 30*a* and 30*b*. The push bar connector 30*a* and 30*b* simply slides along the stabilizer bar 34 during operation. The stabilizer bar 34 can provide a low friction surface, such as a Teflon® coating, plastic, metal, composite, and the like, as understood by one of ordinary skill in the art, or can have merely a wood surface. The stabilizer bar 34 can also include additional features that reduce the friction forces acting on the push bar connector 30*a* and 30*b* during operation, such as the stabilizer bar 34 rotating as the push bar connector 30*a* and 30*b* moves, or by some other means as understood by one of ordinary skill in the art.

Upon initial installation of the garage door opener mechanism 20, it may be necessary to adjust a length of the push bar connector 30*a* and 30*b* to a particular installment configuration. Thus, the push bar connector 30*a* and 30*b* includes an adjustment mechanism 36, which can have multiple different embodiments as later discussed herein. The adjustment mechanism 36 enables the initial setting of the length of the push bar connector 30*a* and 30*b* upon initial installation. In addition to the adjustment mechanism 36, a spring 38 and slip joint 40 provide additional flexure and minor length adjustment for the push bar connector 30*a* and 30*b* during operation as described later herein.

The motor 22 mounts to a mounting structure 46, which is commonly a ceiling, or beam extending from a ceiling, of a building into which the doors 31 and 32 provide access.

Figure 4A:
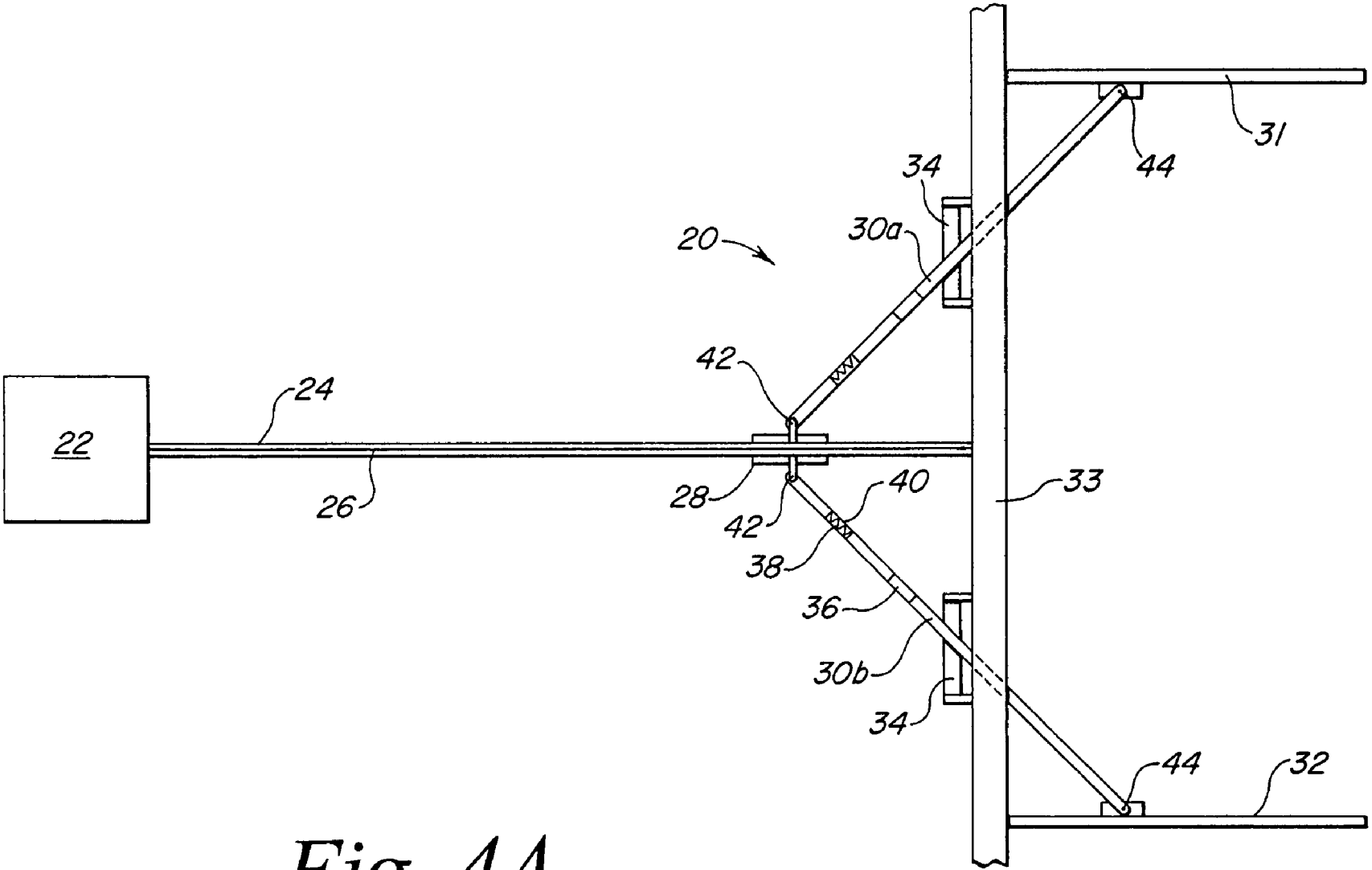
FIG. 4A is a diagrammatic illustration of the door opener with doors in an open state, according to one aspect of the present invention.
Figure 4B:
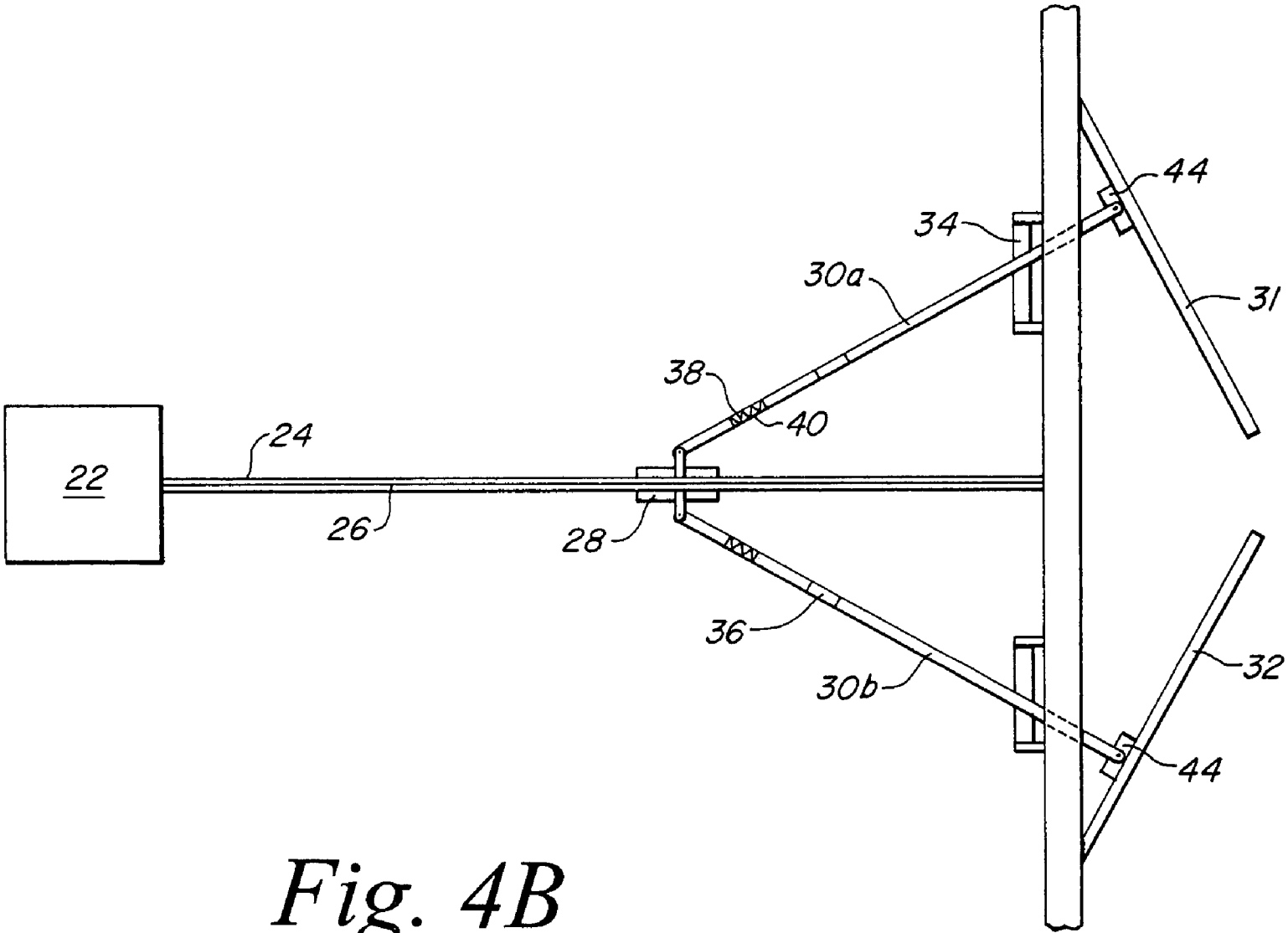
FIG. 4B is a diagrammatic illustration of the door opener with doors in a partially closed state, according to one aspect of the present invention.
Figure 4C:
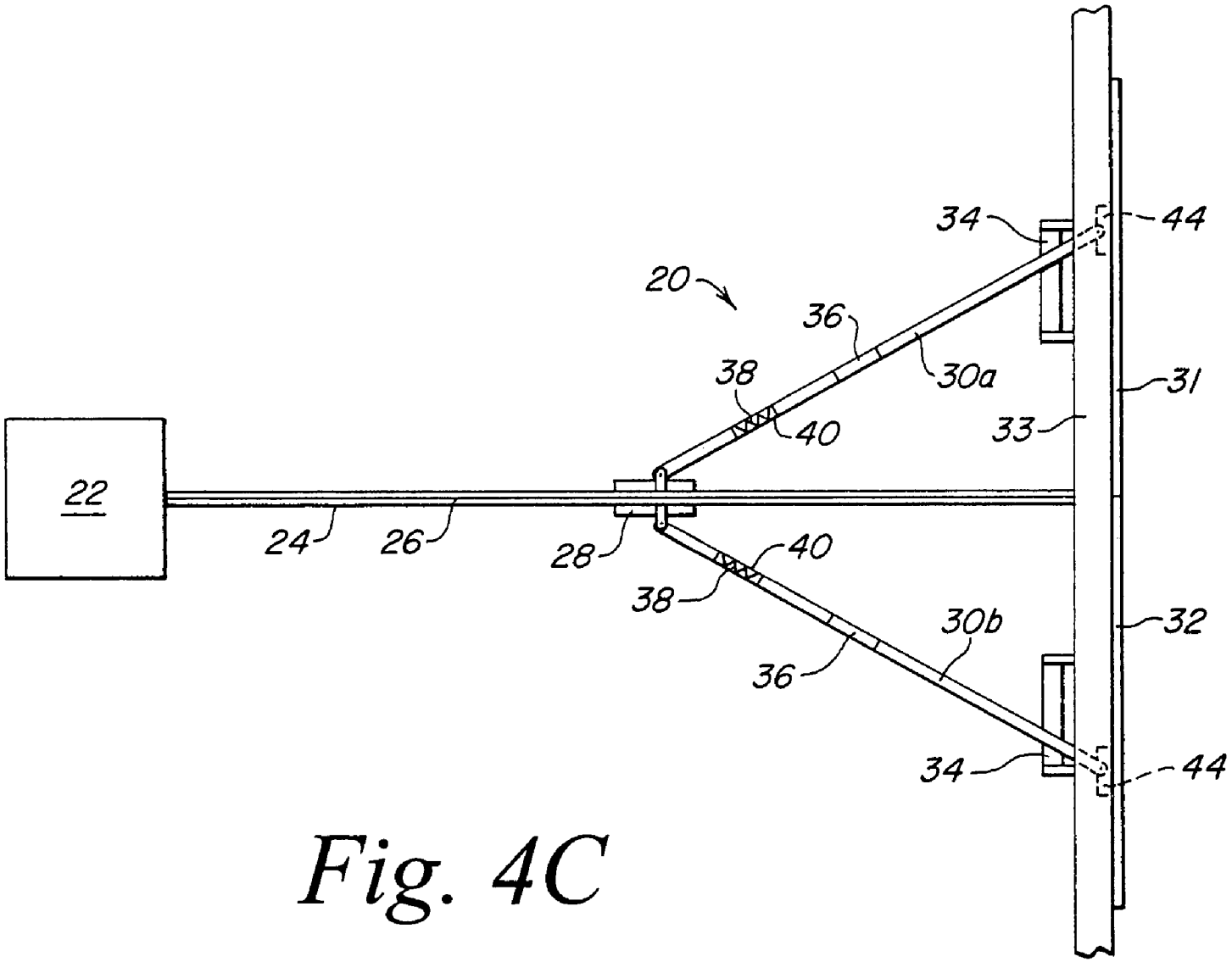
FIG. 4C is a diagrammatic illustration of the door opener with doors in a filly closed state, according to one aspect of the present invention.

FIGS. 4A, 4B, and 4C illustrate the garage door opener mechanism 20 in various states of operation. FIG. 4A illustrates the garage door opener mechanism 20 with the first door 31 and the second door 32 in an open state. FIG. 4B illustrates the garage door opener mechanism 20 with the first door 31 and the second door 32 in a partially closed state. FIG. 4C illustrates the garage door opener mechanism 20 with the first door 31 and the second door 32 in a fully closed state.

As can be seen in the figures, when the first door 31 and the second door 32 are in an open state, the push bar connector 30*a* and 30*b* extends outwardly from the track 24 to form an angle $\alpha$ therebetween. Angle $\alpha$ can range between approximately zero degrees and approximately 89 degrees, depending on the configuration and position of the stabilizer bars 34 and the first door 31 and second door 32. More specifically, once the push bar connector 30*a* and 30*b* has extended beyond about 89 degrees to about 90 degrees or more, the push bar connector 30*a* and 30*b* can provide no further outward push force on the first door 31 or the second door 32 as understood by one of ordinary skill in the art, unless there were additional spring forces or other forces applied to the push bar connector 30*a* and 30*b* to bring it back to the appropriate range. More preferably, the angle a formed by the push bar connector 30*a* and 30*b* will operate within a range of about 20 degrees to about 60 degrees. However, the present invention is not limited to the configuration of angle $\alpha$ being between about 20 degrees and about 60 degrees when the first door 31 and second door 32 are in a fully open state. The range of between about 20 degrees and about 60 degrees results in more outward travel distance for relatively shorter travel distance on the track 24, as understood by one of ordinary skill in the art, but the garage door opener mechanism 20 can operate with angle $\alpha$ in ranges outside of about 20 degrees and about 60 degrees.

To move the first door 31 and the second door 32 toward a closed state, the motor 22 is activated causing the drive 26 to pull the trolley 28 toward the motor 22. With this movement, the angle $\alpha$ begins to decrease as the push bar connector 30*a* and 30*b* pulls on the first door 31 and the second door 32. The first door 31 and the second door 32 thus begin to close. Proceeding to FIG. 4C, the first door 31 and the second door 32 arrive at a closed state or closed position, and angle $\alpha$ has decreased to a position between approximately 10 degrees and 30 degrees. Again, one of ordinary skill in the art will appreciate that the range of angle $\alpha$ in the closed state can vary depending on the configuration of the particular garage door opener mechanism installation, and thus is not limiting to the invention. To open the doors, the motor 22 pushes the trolley 28 in an opposite direction, causing angle α to increase as the push bar connector 30*a* and 30*b* pushes the first door 31 and the second door 32 toward the open state or position.

Figure 5:
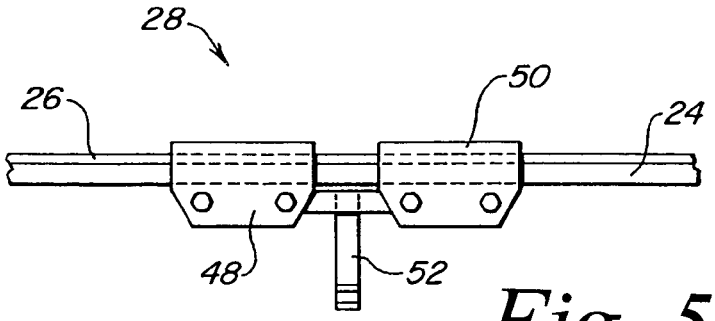
FIG. 5 is a diagrammatic illustration of a trolley according to one aspect of the present invention.

FIG. 5 illustrates one example embodiment of the trolley 28 in accordance with the present invention. The trolley 28 generally slides or rolls along the track 24 and is connected with the drive 26. Thus, when the drive 26 is powered by the motor 22, the trolley 28 moves in a direction along the track 24 in accordance with the direction of the drive 26. As illustrated, the trolley 28 includes a first trolley mechanism 48 and a second trolley mechanism 50. The first trolley mechanism 48 couples with the second trolley mechanism 50 using a trolley bracket 52. Thus, the first trolley mechanism 48 and the second trolley mechanism 50 combine to form the trolley 28.

One of ordinary skill in the art will appreciate that the trolley 28 can have many different configurations. The configuration illustrated in FIG. 5 represents one installation making use of an existing trolley mechanism from an existing conventional garage door opener kit. The trolley mechanism from the conventional garage door opener kit is embodied as the first trolley mechanism 48. The second trolley mechanism 50 represents a second trolley mechanism substantially the same as the first trolley mechanism and obtained from the supplier or manufacturer of the convention garage door opener kit. More specifically, in the instance where the present garage door opener mechanism 20 is sold as a complete garage door opener kit, both the first trolley mechanism 48 and the second trolley mechanism 50 would be provided, and may be embodied in the form of a single trolley. However, in the instance where the garage door opener mechanism 20 is sold in a kit for modifying a conventional garage door opener, the conventional garage door opener will include the first trolley mechanism 48 and the user must then purchase a second version of the trolley mechanism in the form of the second trolley mechanism 50 and couple the second trolley mechanism 50 to the first trolley mechanism 48 with the trolley bracket 52 as discussed later herein.

The purpose of coupling the first trolley mechanism 48 with the second trolley mechanism 50 is to provide greater stability for controlling the push bar connector 30*a* and 30*b*. The first trolley mechanism 48 coupled with the second trolley mechanism 50 creates a relatively wider trolley 28, thus providing more track stability. In the instance of a single trolley mechanism to form the trolley 28, the single trolley mechanism is made wider than a conventional trolley mechanism (i.e., the first trolley mechanism 48 or the second trolley mechanism 50).

Figure 6:
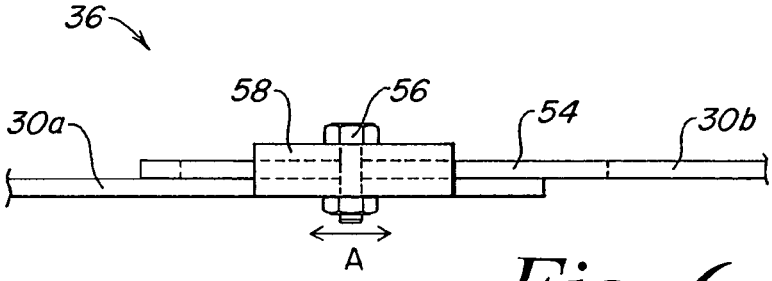
FIG. 6 is a diagrammatic illustration of an adjustment mechanism according to one aspect of the present invention.
Figure 7:
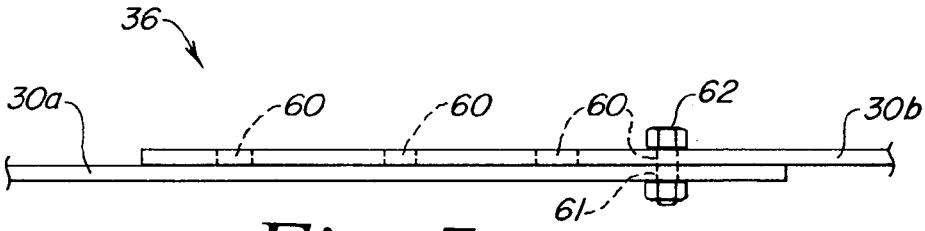
FIG. 7 is a diagrammatic illustration of another adjustment mechanism according to one aspect of the present invention.

FIG. 6 and FIG. 7 illustrate two different embodiments of the adjustment mechanism 36. The adjustment mechanism 36 provides the ability to lengthen or shorten the push bar connector 30*a* and 30*b* upon initial installation of the garage door opener mechanism 20. In FIG. 6, the adjustment mechanism 36 is formed by a combination of a slot 54 formed in one member of the push bar connector 30*a* and 30*b* and sandwiched between another member of the push bar connector 30*a* and 30*b* and an adjustment clip 58. The adjustment clip 58 and the push bar connector 30*a* and 30*b* are held together with the adjustment clip 58 utilizing a fastener 56, such as a bolt. The push bar connector 30*a* and 30*b* can be lengthened or shortened in the direction of arrow A by loosening the fastener 56 and either extending or compressing the push bar connector 30*a* and 30*b*, such that the fastener 56 moves along the slot 54. Once a desired length of the push bar connector 30*a* and 30*b* is achieved, the fastener 56 is tightened to clamp the adjustment clip 58 together with the push bar connector 30*a* and 30*b* and hold the push bar connector 30*a* and 30*b* in place as a single member.

Alternatively, FIG. 7 illustrates the push bar connector 30*a* and 30*b* in two components, one of which includes a plurality of adjustment holes 60. Utilizing a fastener 62, such as a bolt, the push bar connector 30*a* and 30*b* is extended to a desired length approximately matching up one of the adjustment holes 60 with a fastener hole 61. The fastener 62 is then inserted through the desired adjustment hole 60 and the fastener hole 61 and tightened to clamp the components of the push bar connector 30*a* and 30*b* and form a single member. One of ordinary skill in the art will appreciate that the example adjustment mechanisms 36 as illustrated in FIGS. 6 and 7 are only examples of a number of different adjustment mechanism possibilities. The present invention is thus not limited to only the two examples illustrated, but generally encompasses the concept of having an adjustable length push bar connector 30*a* and 30*b* for enabling installation of the garage door opener mechanism 20 in a number of different configurations.

Figure 8:
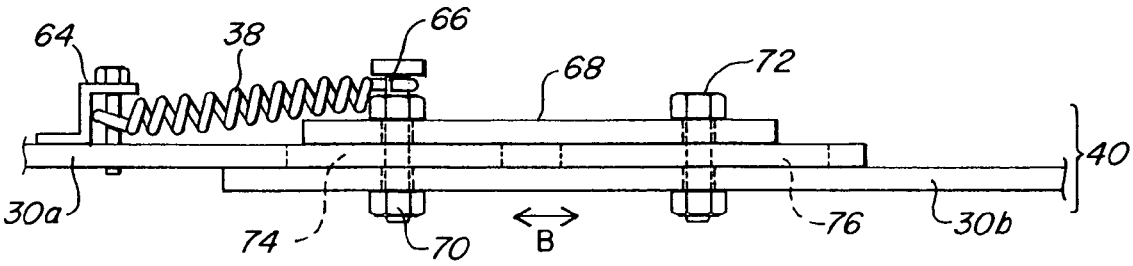
FIG. 8 is a diagrammatic illustration of a spring and slip joint according to one aspect of the present invention.

FIG. 8 illustrates another fine tuning length adjustment of the push bar connector 30*a* and 30*b* in the form of the spring 38 working in combination with the slip joint 40. The slip joint 40 is formed by the members of the push bar connector 30*a* and 30*b*, one of which includes a first slot 74 and a second slot 76. The slip joint further includes a spring platform 68 through which a first fastener 70 and second fastener 72 pass. A spring bracket 64 anchors one end of the spring 38 to the push bar connector 30*a* and 30*b*, while a spring post 66 anchors a second end of the spring to the spring platform 68.

Upon initial installation, the spring 38 pulls the spring post 66 such that the first fastener 70 and the second fastener 72 are pinned on a left side of the first slot 74 and the second slot 76, respectively, as illustrated. In other words, the spring 38 is installed to be relatively taut when the push bar connector 30*a* and 30*b* has no compression or expansion forces applied thereon. Upon activation of the garage door opener mechanism 20 to close a door, the push bar connector 30*a* and 30*b* is pulled by the trolley 28 as previously described. Once the door (e.g., first door 31 or second door 32) reaches a closed state, the trolley 28 may be pulled for an additional small distance. To allow for the trolley 28 to continue movement after the door has closed, the slip joint 40 allows the push bar connector 30*a* and 30*b* to expand with the spring 38 providing an opposing spring force. The push bar connector 30*a* and 30*b* begins to expand or lengthen, causing the slip joint 40 to slide as the first fastener 70 and the second fastener 72 move within the first slot 74 and the second slot 76. Such movement continues until the trolley 28 stops. The use of the slip joint 40 allows a snug closing of the first door 31 or second door 32, in that the garage door opener mechanism 20 does not have to be adjusted using the adjustment mechanism 36 to result in the trolley 28 stopping at the exact position where the first door 31 and the second door 32 are in a closed position. Some play is allowed, and such things as the first door 31 or the second door 32 being slightly warped or having some minor obstruction such as a rock or other hindrance will still result in the first door 31 and the second door 32 being held tightly against the door frame 33 when in a closed position because of the spring force provided by the spring 38 on the slip joint 40.

The present invention, therefore, provides a garage door opener device for opening outwardly swinging doors having substantially or relatively vertically aligned hinges on one side of the door. The present invention can be embodied either as a kit for use with conventional automated garage door openers, or a complete garage door opener device.

Numerous modifications and alternative embodiments of the present invention will be apparent to those skilled in the art in view of the foregoing description. Accordingly, this description is to be construed as illustrative only and is for the purpose of teaching those skilled in the art the best mode for carrying out the present invention. Details of the structure may vary substantially without departing from the spirit of the present invention, and exclusive use of all modifications that come within the scope of the appended claims is reserved. It is intended that the present invention be limited only to the extent required by the appended claims and the applicable rules of law.

What is claimed is:

1. A door opener for opening and closing an outwardly swinging door mounted for pivotal movement by substantially vertically aligned hinges disposed on one side of the outwardly swinging door such that the door swings outwardly to reveal an opening and swings inwardly to block the opening, the door opener comprising:

a track extending inwardly in a direction substantially opposite from the direction of swing of the outwardly swinging door;

a trolley slidably coupled with the track, such that the trolley can move along the track generally toward the outwardly swinging door and generally away from the outwardly swinging door;

at least one push bar having a first distal end and a second distal end, the push bar pivotally coupled with the trolley at the first end and configured for pivotal coupling with the outwardly swinging door at the second end, the at least one push bar comprising a slip joint coupled with a tension spring which adjusts a distance between the distal ends of the at least one push bar during operation of the door opener;

wherein movement of the trolley along the track in a first direction is adapted to cause the push bar to push on the outwardly swinging door; and wherein movement of the trolley along the track in a second direction opposite the first direction is adapted to cause the push bar to pull on the outwardly swinging door.

2. The door opener of claim 1, further comprising a drive mechanism for moving the trolley along the track.

3. The door opener of claim 2, wherein the drive mechanism comprises at least one of a screw drive and a chain drive.

4. The door opener of claim 2, further comprising a motor for powering the drive mechanism.

5. The door opener of claim 1, wherein the trolley comprises a first trolley mechanism and a second trolley mechanism, the first trolley mechanism coupled with the second trolley mechanism.

6. The door opener of claim 1, wherein the at least one push bar further comprises at least one adjustment mechanism for adjusting a length of the at least one push bar.

7. The door opener of claim 1, wherein the slip joint coupled with the spring enables lengthening of the at least one push bar while the at least one push bar is adapted to maintain a pulling force on the door when the trolley moves in the second direction.

8. The door opener of claim 1, further comprising a stabilizer bar for supporting the at least one push bar.

9. The door opener of claim 1, wherein the at least one push bar comprises a first push bar and a second push bar, the first push bar and the second push bar being disposed on opposing sides of the track.

10. The door opener of claim 9, wherein the door opener is configured to open the outwardly swinging door and a second outwardly swinging door substantially simultaneously.

* * * * *